US007920708B2

(12) United States Patent
Trautmann et al.

(10) Patent No.: US 7,920,708 B2
(45) Date of Patent: Apr. 5, 2011

(54) LOW COMPUTATION MONO TO STEREO CONVERSION USING INTRA-AURAL DIFFERENCES

(75) Inventors: Steven D. Trautmann, Ibaraki (JP); Ryo Tsutsui, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 1175 days.

(21) Appl. No.: 11/560,387

(22) Filed: Nov. 16, 2006

(65) Prior Publication Data

US 2008/0118071 A1 May 22, 2008

(51) Int. Cl.
*H04R 5/00* (2006.01)

(52) U.S. Cl. ..... 381/17

(58) Field of Classification Search ..... 381/17, 381/1, 310, 18

See application file for complete search history.

(56) References Cited

U.S. PATENT DOCUMENTS

| | | | | |
|---|---|---|---|---|
| 4,039,755 | A * | 8/1977 | Berkovitz | 381/63 |
| 4,586,417 | A * | 5/1986 | Kato et al. | 84/630 |
| 4,980,914 | A * | 12/1990 | Kunugi et al. | 381/1 |
| 5,369,224 | A * | 11/1994 | Miyata | 84/662 |
| 5,657,391 | A * | 8/1997 | Jyosako | 381/1 |
| 6,005,946 | A * | 12/1999 | Varga et al. | 381/17 |
| 6,175,631 | B1 * | 1/2001 | Davis et al. | 381/17 |
| 6,714,652 | B1 * | 3/2004 | Davis et al. | 381/17 |
| 6,885,752 | B1 * | 4/2005 | Chabries et al. | 381/321 |
| 7,664,271 | B2 * | 2/2010 | Suzaki et al. | 381/10 |
| 2006/0029231 | A1 * | 2/2006 | Henn et al. | 381/1 |

* cited by examiner

*Primary Examiner* — Curtis Kuntz
*Assistant Examiner* — Hai Phan
(74) *Attorney, Agent, or Firm* — Robert D. Marshall, Jr.; W. James Brady; Frederick J. Telecky, Jr.

(57) ABSTRACT

A method of converting single channel audio (mono) signals to two channel audio (stereo) signals using simple filters and an Intra-aural Time Difference (ITD) is presented. This method does not distort the spectral content of the original signal very much, and has low computation requirements. A variation is proposed which also uses Intra-aural Intensity Difference (IID).

9 Claims, 3 Drawing Sheets

LOW COMPUTATION MONO TO STEREO CONVERSION USING INTRA-AURAL DIFFERENCES

CROSS REFERENCE TO RELATED APPLICATIONS

This application is related to contemporaneously filed U.S. patent application Ser. No. 11/560,397 BAND-SELECTABLE STEREO SYNTHESIZER USING STRICTLY COMPLEMENTARY FILTER PAIR and U.S. patent application Ser. No. 11/560,390 STEREO SYNTHESIZER USING COMB FILTERS AND INTRA-AURAL DIFFERENCES.

TECHNICAL FIELD OF THE INVENTION

The technical field of this invention is stereo synthesis from monaural inputs.

BACKGROUND OF THE INVENTION

Converting mono audio signals to stereo is a common need in current audio electronics. Two channel stereo sound is now standard. Two channel stereo generally has a much more natural and pleasant quality than mono. People naturally hear everyday sounds in stereo. There are still situations where mono sound signals exist such as telephone conversations, old recordings, low-end toys and radios etc. Converting such signals to stereo can greatly enhance their naturalness.

A mono signal carries no directional clues to the original location of the recorded sources. Additionally the original sound should be modified as little as possible to avoid coloration. Since mono signals are more common in low-end equipment, the computational cost of the mono to stereo conversion should be at a minimum because the low-end equipment typically has limited computational capacity.

SUMMARY OF THE INVENTION

This invention decomposes the original mono signal with filters, adds intra-aural time differences (ITD) using delays and optionally attenuates or filters representing intra-aural intensity differences (IID) and mixes to stereo. These intra-aural time differences and the optional intra-aural intensity differences provide directional clues in a mono to stereo conversion with low computational cost and low distortion.

Low computation is achieved depending on the filters used. Very good stereo quality can be achieved by centering the vocal range, moving the lower frequencies to the right side and moving the higher frequencies to the left side. This is similar to many musical performance situations. If only ITD is used, there is very little distortion compared to the mono signal while still producing a realistic stereo sensation. A great deal of flexibility is available choice of the cut-off frequencies and the ITDs and optional IIDs.

BRIEF DESCRIPTION OF THE DRAWINGS

These and other aspects of this invention are illustrated in the drawings, in which.

DETAILED DESCRIPTION OF PREFERRED EMBODIMENTS

The basic technique of this invention splits the mono signal into two or more different signals using filters. These different signals are sent to respective left and right channels of the stereo signal output with different delays. This produces different left and right channel signals. Different left and right channel gains may optionally be applied. Using simple complementary filters without gain reduces or eliminates coloration of the stereo signal.

A mono signal has few clues about source locations. However, many people are accustomed to hearing speaking or singing the center and high and low frequencies to the sides. For many live orchestras and some rock bands the low instruments tend to be toward the right and the high instruments tend to be on the left. This invention uses three filters corresponding to a mid-range band-pass, a hi-pass and a low-pass. These filters were designed to be complementary. Often in movies and in many recordings, the vocal sounds, whether singing or speaking, tend to be centered. Additionally overall balance between signals appearing to come from the left and right channels is important. For these reasons, the mid-range was chosen to be between approximately 200 Hz and 1500 Hz. The low range is thus 0 to 200 Hz and the high range was everything from 1500 Hz to the Nyquist frequency. The filters are complementary to minimize distortion of the spectral content of the mono signal.

Figure 1:
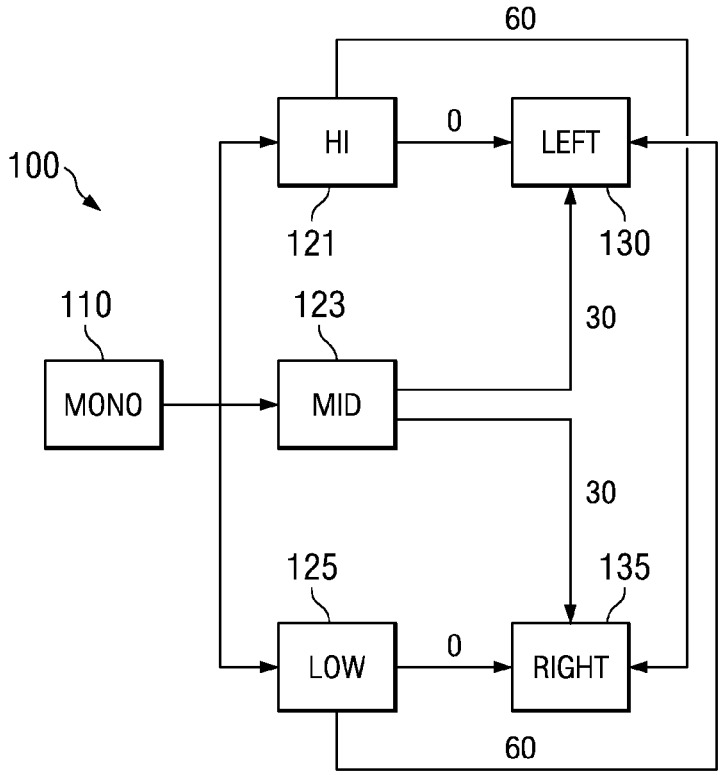
FIG. 1 illustrates a first embodiment of this invention in block diagram form.

FIG. 1 illustrates a basic embodiment 100 of this invention in block diagram form. The input mono signal 110 is sampled at 44.1 KHz. Thus the Nyquist frequency was 22.05 KHz. For the experiment described below, input mono signal 110 was a produced by mixing the left and right channels of a stereo recording of a rock tune.

Input mono signal 110 is supplied to high-pass filter 121, mid-range band pass filter 123 and low-pass filter 125. For this experiment filters 121, 123 and 125 were embodied by 1025 tap linear phase finite impulse response (FIR) filters. Shorter, simpler infinite impulse response (IIR) filters could be used to minimize the computational cost.

Left channel 130 and right channel 135 result from summation of various delayed and undelayed signals from filters 121, 123 and 125. Left channel 130 receives an undelayed signal from high-pass filter 121. Right channel 135 receives the signal from high-pass filter 121 delayed by 60 samples, or 0.00136 seconds at the 44.1 KHz sampling frequency. Similarly, right channel 135 receives an undelayed signal from low-pass filter 125 and left channel 130 receives the signal from low-pass filter 125 delayed by 60 samples. This 60 sample delay corresponds approximately to the intra-aural time difference for a sound coming from the right or left. The embodiment of FIG. 1 applies no other direction clues such as gain difference to minimize the difference between the synthesized stereo signal and the original mono signal. Equal delays were applied to the signal from mid-range band pass filter 123 to left channel 130 and right channel 135. Thus the mid-range signal arrives at both ears at the same time to correspond to a frontal location. This tends to center both speaking and singing voices. A 30 sample delay was chosen for the mid-range in order to split the difference between the 0 sample and 60 sample delays used elsewhere to minimize the amount of delay the high frequency and low frequency signals have relative to the mid-range signal. These pure delays are summarized in Table 1 below.

TABLE 1

| Source | Left Channel 130 | Right Channel 135 |
|---|---|---|
| high-pass filter 121 | 0 samples | 60 samples |
| mid-range band pass filter 123 | 30 samples | 30 samples |
| low pass filter 124 | 60 samples | 0 samples |

The resulting synthesized stereo signal had a very reasonable stereo effect. The mid-range, including vocals, seemed to come from the front, while the bass seemed to come more from the right and the high frequencies more from the left. The overall quality of the synthesized stereo signal was similar to the original mono signal. The synthesized stereo signal had nothing close to a complete recovery of the stereo input source. For example, all panning effects were lost for voices.

If producing a realistic stereo effect is more important than approximating the original mono signal, then another technique can be used. This second embodiment adds an attenuation term the high-pass signal to the right ear to approximate the intra-aural intensity difference (IID) due to the head's attenuation of sounds from the opposite side. Likewise an attenuation term can be applied to the low-pass signal to the left ear. This attenuation is not as important since the head tends to attenuate higher frequencies more than lower ones. A simple attenuation term is the least computationally expensive, however a low-pass filter could be included to further enhance the simulated attenuation due to the head. This takes advantage of the fact that the head attenuates lower frequencies less than higher frequencies. Such a low-pass filter could be very gentle and thus could be computationally very simple.

Figure 2:
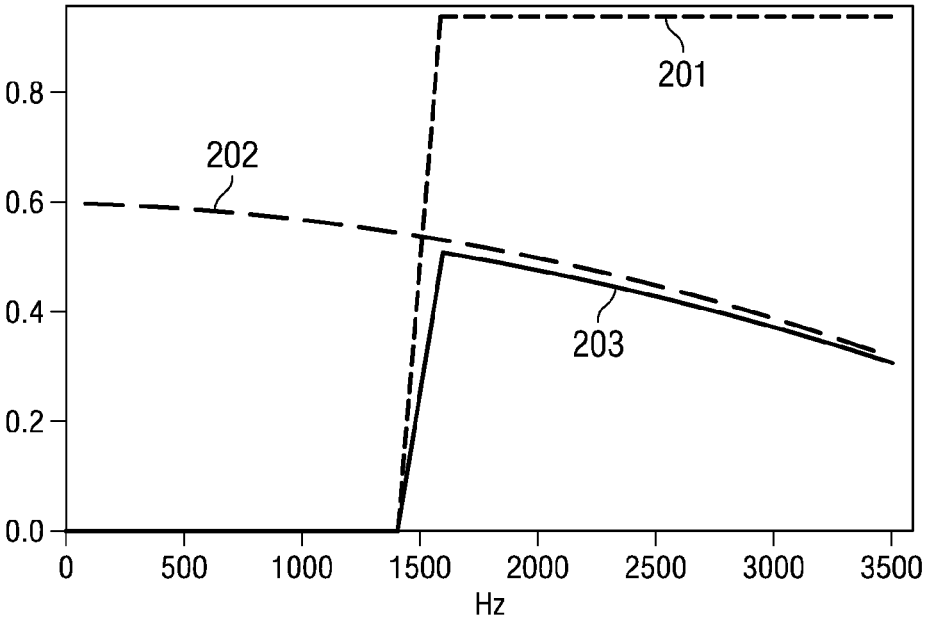
FIG. 2 illustrates the high-pass separation filter response, the low-pass intra-aural intensity difference (IID) and the combined response of the right channel of the embodiment of FIG. 1.

FIG. 2 illustrates the magnitude response of the right channel according to this second embodiment. Curve 201 is the response of the high-pass filter such as high-pass filter 121. Curve 202 is the response of the combined IID attenuation low-pass filter. Curve 203 illustrates the combined response for the right channel.

Figure 3:
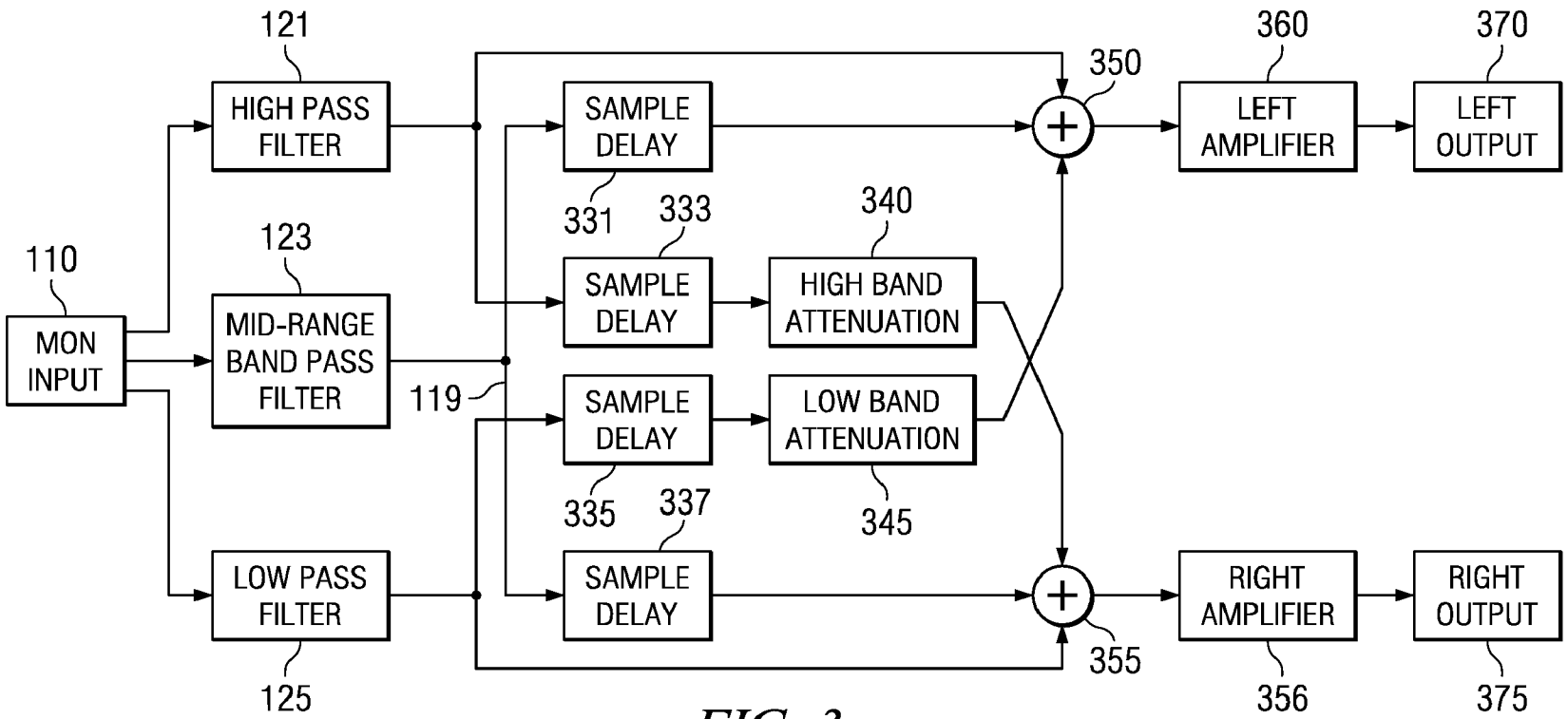
FIG. 3 illustrates a second embodiment of this invention in block diagram form.

FIG. 3 is a block diagram of this second embodiment. Input mono signal 110 is supplied to high-pass filter 121, mid-range band pass filter 123 and low-pass filter 125 as previously described in conjunction with FIG. 1. There are four delay blocks: 30 sample delay 331 receiving the output of mid-range band pass filter 123 and supplying adder 350; 60 sample delay 333 receiving the output of high-pass filter 121 and supplying attenuation unit 340; 60 sample delay 335 receiving the output of low-pass filter 125 and supplying attenuation unit 345; and 30 sample delay 337 receiving the output of mid-range band pass filter 123 and supplying adder 355. These delay blocks provide the ITD as previously described. Attenuation units 340 and 345 represent attenuations or combined attenuation units and low pass filters used to represent the IID. Attenuation unit 340 provides a larger attenuation than attenuation unit 345. This difference is related to the difference in high frequency and low frequency attenuation by the head. In addition attenuation unit 345 may be considered optional.

Summer 350 sums the direct output of high-pass filter 121, the output of delay unit 331 and the output of attenuation unit 345. Summer 355 sums the direct output of low-pass filter 123, the output of delay unit 337 and the output of attenuation unit 340. Attenuation units 360 and 365 are optional. These attenuation units if provided balance the resulting left channel output 370 and right channel 375.

Figure 4:
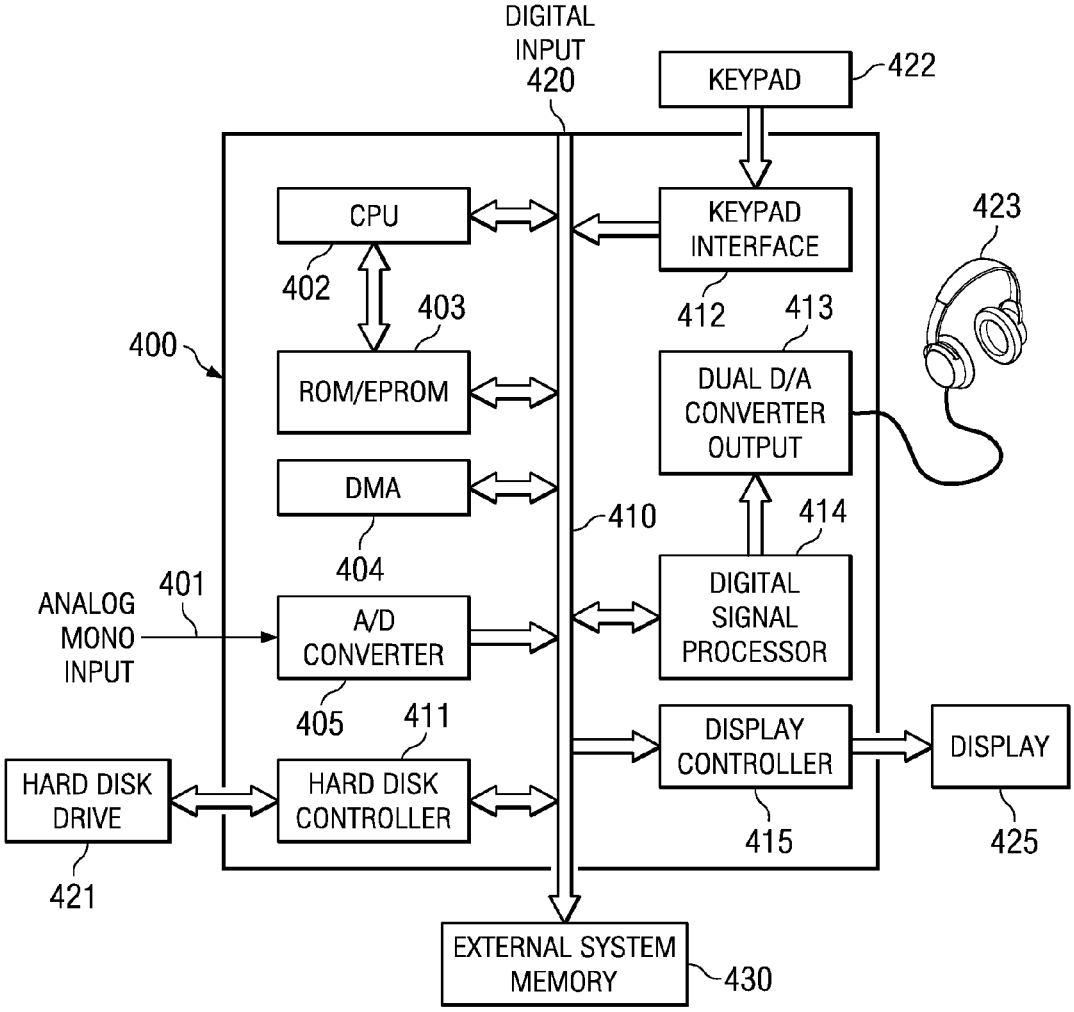
FIG. 4 illustrates a portable music system such as might use this invention.

FIG. 4 illustrates a block diagram of an example consumer product that might use this invention. FIG. 4 illustrates a portable compressed digital music system. This portable compressed digital music system includes system-on-chip integrated circuit 400 and external components hard disk drive 421, keypad 422, headphones 423, display 425 and external memory 430.

The compressed digital music system illustrated in FIG. 4 stores compressed digital music files on hard disk drive 421. These are recalled in proper order, decompressed and presented to the user via headphones 423. System-on-chip 400 includes core components: central processing unit (CPU) 402; read only memory/erasable programmable read only memory (ROM/EPROM) 403; direct memory access (DMA) unit 404; analog to digital converter 405; system bus 410; and digital input 420. System-on-chip 400 includes peripherals components: hard disk controller 411; keypad interface 412; dual channel (stereo) digital to analog converter and analog output 413; digital signal processor 414; and display controller 415. Central processing unit (CPU) 402 acts as the controller of the system giving the system its character. CPU 402 operates according to programs stored in ROM/EPROM 403. Read only memory (ROM) is fixed upon manufacture. Suitable programs in ROM include: the user interaction programs that control how the system responds to inputs from keypad 412 and displays information on display 425; the manner of fetching and controlling files on hard disk drive 421 and the like. Erasable programmable read only memory (EPROM) may be changed following manufacture even in the hand of the consumer in the field. Suitable programs for storage in EPROM include the compressed data decoding routines. As an example, following purchase the consumer may desire to enable the system to be capable of employing compressed digital data formats different from or in addition to the initially enabled formats. The suitable control program is loaded into EPROM from digital input 420 via system bus 410. Thereafter it may be used to decode/decompress the additional data format. A typical system may include both ROM and EPROM.

Direct memory access (DMA) unit 404 controls data movement throughout the whole system. This primarily includes movement of compressed digital music data from hard disk drive 421 to external system memory 430 and to digital signal processor 414. Data movement by DMA 404 is controlled by commands from CPU 402. However, once the commands are transmitted, DMA 404 operates autonomously without intervention by CPU 402.

System bus 410 serves as the backbone of system-on-chip 400. Major data movement within system-on-chip 400 occurs via system bus 410.

Hard drive controller 411 controls data movement to and from hard drive 421. Hard drive controller 411 moves data from hard disk drive 421 to system bus 410 under control of DMA 404. This data movement would enable recall of digital music data from hard drive 421 for decompression and presentation to the user. Hard drive controller 411 moves data from digital input 420 and system bus 410 to hard disk drive 421. This enables loading digital music data from an external source to hard disk drive 421.

Keypad interface 412 mediates user input from keypad 422. Keypad 422 typically includes a plurality of momentary contact key switches for user input. Keypad interface 412 senses the condition of these key switches of keypad 422 and signals CPU 402 of the user input. Keypad interface 412 typically encodes the input key in a code that can be read by CPU 402. Keypad interface 412 may signal a user input by transmitting an interrupt to CPU 402 via an interrupt line (not shown). CPU 402 can then read the input key code and take appropriate action.

Dual digital to analog (D/A) converter and analog output 413 receives the decompressed digital music data from digital signal processor 414. This provides a stereo analog signal to headphones 423 for listening by the user. Digital signal processor 414 receives the compressed digital music data and decompresses this data. There are several known digital music compression techniques. These typically employ similar algorithms. It is therefore possible that digital signal processor 414 can be programmed to decompress music data according to a selected one of plural compression techniques.

Display controller 415 controls the display shown to the user via display 425. Display controller 415 receives data from CPU 402 via system bus 410 to control the display. Display 425 is typically a multiline liquid crystal display (LCD). This display typically shows the title of the currently playing song. It may also be used to aid in the user specifying playlists and the like.

External system memory 430 provides the major volatile data storage for the system. This may include the machine state as controlled by CPU 402. Typically data is recalled from hard disk drive 421 and buffered in external system memory 430 before decompression by digital signal processor 414. External system memory 430 may also be used to store intermediate results of the decompression. External system memory 430 is typically commodity DRAM or synchronous DRAM.

The portable music system illustrated in FIG. 4 includes components to employ this invention. An analog mono input 401 supplies a signal to analog to digital (A/D) converter 405. A/D converter 405 supplies this digital data to system bus 410. DMA 404 controls movement of this data to hard disk 421 via hard disk controller 411, external system memory 430 or digital signal processor 414. Digital signal processor is preferably programmed via ROM/EPROM 403 to apply the stereo synthesis of this invention to this digitized mono input. Digital signal processor 414 is particularly adapted to implement the filter functions of this invention for stereo synthesis. Those skilled in the art of digital signal processor system design would know how to program digital signal processor 414 to perform the stereo synthesis process described in conjunction with FIGS. 1 to 3. The synthesized stereo signal is supplied to dual D/A converter and analog output 413 for the use of the listener via headphones 423. Note further that a mono digital signal may be delivered to the portable music player via digital input for storage in hard disk drive 421 or external memory 430 or direct stereo synthesis via digital signal processor 414.

This invention is a method for creating synthetic stereo from a mono signal using intra-aural time differences. This application describes a particular implementation of the general method which produced good results in the sense of having a realistic stereo image. This application also described an alternative embodiment which includes an approximation of intra-aural intensity differences.

What is claimed is:

1. A method of synthesizing stereo sound from a monaural sound signal comprising the steps of:

high pass filtering the monaural sound signal;

delaying said high pass filtered monaural sound signal a first predetermined delay;

low pass filtering the monaural sound signal;

delaying said low pass filtered monaural sound signal said first predetermined delay;

band pass filtering the monaural sound signal;

delaying said band pass filtered monaural sound signal a second predetermined delay;

summing only said high pass filtered monaural sound signal, said delayed band pass signal and said delayed low pass filtered signal to produce a first stereo output signal; and summing only said low pass filtered monaural sound signal, said delayed band pass signal and said delayed high pass monaural sound signal to produce a second stereo output signal.

2. The method of claim 1, wherein:

said step of band pass filtering said monaural sound signal has a pass band including the frequency range of a human voice;

said step of high pass filtering said monaural sound signal has a pass band above the frequency range of a human voice; and said step of low pass filtering said monaural sound signal has a pass band below the frequency range of a human voice.

3. The method of claim 1, wherein:

said step of band pass filtering said monaural sound signal has a pass band of 200 Hz to 1500 Hz;

said step of high pass filtering said monaural sound signal has a pass band above 1500 Hz; and said step of low pass filtering said monaural sound signal has a pass band below the 200 Hz.

4. The method of claim 1, wherein:

said first predetermined delay is a delay for sound to cross a listeners head from one ear to an opposite ear; and said second predetermined delay is half said first predetermined delay.

5. The method of claim 1, wherein:

said first predetermined delay is 0.00136 seconds; and said second predetermined delay is 0.00068 seconds.

6. The method of claim 1, further comprising:

attenuating said delayed high pass filtered monaural sound signal before said summing to produce said second stereo output signal.

7. The method of claim 6, wherein:

said step of attenuating said delayed high pass filtered monaural sound signal attenuates an amount equal to attenuation of said high pass filtered monaural sound signal attenuates in crossing a listener's head from one ear to an opposite ear.

8. The method of claim 6, further comprising:

attenuating said delayed low pass filtered monaural sound signal before said summing to produce said first stereo output signal.

9. The method of claim 8, wherein:

said step of attenuating said delayed low pass filtered monaural sound signal attenuates an amount equal to attenuation of said low pass filtered monaural sound signal attenuates in crossing a listener's head from one ear to an opposite ear.

* * * * *